US012286861B2

(12) United States Patent
Omer et al.

(10) Patent No.: US 12,286,861 B2
(45) Date of Patent: Apr. 29, 2025

(54) COMBINED ACTUATION OF SLIPS AND PACKER SEALING ELEMENT

(71) Applicant: Schlumberger Technology Corporation, Sugar Land, TX (US)

(72) Inventors: Farhan Ahmed Omer, Guadalupe NL (MX); Susan Wu, Rosharon, TX (US); Thomas Eric Dudley, Rosharon, TX (US); Yiming Fan, Rosharon, TX (US); Weiming Lan, Rosharon, TX (US); Nitin Verroju, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/607,751

(22) Filed: Mar. 18, 2024

(65) Prior Publication Data

US 2024/0218757 A1 Jul. 4, 2024

Related U.S. Application Data

(63) Continuation of application No. 17/755,005, filed as application No. PCT/US2020/056406 on Oct. 20, 2020, now Pat. No. 11,933,133.

(Continued)

(51) Int. Cl.

*E21B 33/12* (2006.01)
*E21B 23/06* (2006.01)

(Continued)

(52) U.S. Cl.

CPC ..... *E21B 33/1212* (2013.01); *E21B 23/06* (2013.01); *E21B 33/1295* (2013.01); *E21B 33/128* (2013.01)

(58) Field of Classification Search

CPC ..... E21B 33/1212; E21B 33/1295; E21B 33/128; E21B 33/129; E21B 23/06; E21B 34/10

See application file for complete search history.

(56) References Cited

U.S. PATENT DOCUMENTS 2,057,859 A * 10/1936 Thaheld ..... E21B 37/10 92/254
3,000,443 A 9/1961 Thompson (Continued)

FOREIGN PATENT DOCUMENTS

| | | |
|---|---|---|
| GB | 2308138 A | 6/1997 |
| RU | 158674 U1 | 1/2016 |
| RU | 2674781 C1 | 12/2018 |

OTHER PUBLICATIONS

International Search Report and Written Opinion issued in PCT Application PCT/US2020/056406 dated Feb. 1, 2021 (12 pages).

(Continued)

*Primary Examiner* — Kristyn A Hall
(74) *Attorney, Agent, or Firm* — Jeffrey D. Frantz

(57) ABSTRACT

A technique facilitates actuation of a packer to a sealing and gripping position along a borehole. The packer includes a packer element structure mounted about a center structure. The packer element structure includes a sealing element mounted along an expandable base such that the sealing element may be radially expanded. Additionally, the packer includes an actuator member connected to a portion of the packer element structure via a release mechanism, e.g. a shear member. A plurality of slips may be located on the actuator member such that linear movement of the actuator member causes successive movement of the packer sealing element and then the slips in the radially outward direction. The packer may be constructed such that this sequential setting motion creates a jarring effect to ensure the slips (Continued)

securely bite into the surrounding wellbore surface, e.g. casing surface.

20 Claims, 7 Drawing Sheets

Related U.S. Application Data

(60) Provisional application No. 63/051,019, filed on Jul. 13, 2020, provisional application No. 62/923,575, filed on Oct. 20, 2019.

(51) Int. Cl.
*E21B 33/128* (2006.01)
*E21B 33/1295* (2006.01)

(56) References Cited

U.S. PATENT DOCUMENTS

| | | | | |
|---|---|---|---|---|
| 4,757,860 | A | 7/1988 | Reimert | |
| 5,333,692 | A | 8/1994 | Baugh | |
| 5,511,620 | A * | 4/1996 | Baugh | E21B 33/1216 166/387 |
| 6,666,276 | B1 | 12/2003 | Yokley | |
| 8,459,347 | B2 | 6/2013 | Stout | |
| 9,534,462 | B2 | 1/2017 | Hayter | |
| 10,240,428 | B2 | 3/2019 | Eldho | |
| 10,287,846 | B2 | 5/2019 | Andersen | |
| 10,605,019 | B2 | 3/2020 | Zakharia | |
| 2004/0069502 | A1 | 4/2004 | Luke | |
| 2005/0051337 | A1 | 3/2005 | Jennings | |
| 2008/0169105 | A1 * | 7/2008 | Williamson | E21B 33/1294 166/374 |
| 2016/0326831 | A1 * | 11/2016 | Reinhardt | E21B 33/1285 |
| 2019/0071943 | A1 * | 3/2019 | Givens | E21B 23/01 |

OTHER PUBLICATIONS

Examination report issued in GC application GC2020-40690, dated Nov. 30, 2021 (6 pages).
International Preliminary Report on Patentability issued in PCT Application PCT/US2020/056406 dated May 5, 2022, 9 pages.
Exam Report issued Under Section 18(3) issued in United Kingdom Patent Application No. GB2205702.0 dated Feb. 20, 2023, 4 pages.
Search and Exam Report issued in Russian Patent Application No. 2022113443 dated Nov. 9, 2023, 13 pages with English translation.

* cited by examiner

COMBINED ACTUATION OF SLIPS AND PACKER SEALING ELEMENT

CROSS-REFERENCE TO RELATED APPLICATION

The present document is a continuation of U.S. patent application Ser. No. 17/755,005, filed Apr. 19, 2022 which claims priority to the National Stage of International Application No. PCT/US2020/056406, filed Oct. 20, 2020, and is based on and claims priority to U.S. Provisional Patent Application Ser. No. 62/923,575, filed Oct. 20, 2019, and U.S. Provisional Patent Application Ser. No. 63/051,019, filed Jul. 13, 2020, which are incorporated herein by reference in their entirety.

BACKGROUND

In many well applications, packers are used along a well string to seal off sections of a borehole. Generally, a packer comprises a sealing element which may be expanded in a radially outward direction to form a seal between a central packer mandrel and a surrounding borehole surface, e.g. an interior casing surface. The packer also may comprise or work in cooperation with slips which have gripping members oriented to engage the surrounding borehole surface. The slips also may be expanded in a radially outward direction until forced into gripping engagement with the surrounding borehole surface so as to securely position the packer at a desired location along the borehole.

SUMMARY

In general, a system and methodology are provided for enabling a packer to be actuated to a sealing and gripping position along a borehole. The packer may be positioned along a variety of well strings and may include a center structure, e.g. mandrel, having a passage therethrough. A packer element structure is mounted about the center structure and includes a sealing element mounted along an expandable base such that the sealing element may be radially expanded. Additionally, the packer includes an actuator member connected to a portion of the packer element structure via a release mechanism, e.g. a shear member. A plurality of slips may be located on the actuator member such that linear movement of the actuator member causes successive movement of the packer sealing element and then the slips in the radially outward direction. The packer may be constructed such that this sequential setting motion creates a jarring effect to ensure the slips securely bite into the surrounding wellbore surface, e.g. casing surface.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for enabling a packer to be actuated to a sealing and gripping position along a borehole. The packer is constructed to enable sequential actuation of the sealing element and then the slips via an actuation input, e.g. a mechanical actuation or a pressure input along the annulus and/or interior of the well string. The packer may be positioned along a variety of well strings and may be located in many types of boreholes, e.g. vertical or deviated wellbores including cased wellbores.

According to an embodiment, the packer may comprise a center structure, e.g. a mandrel structure, having a passage therethrough. A packer element structure is positioned about the center structure and includes a sealing element mounted along an expandable base such that the sealing element may be radially expanded. The sealing element may be formed of a suitable elastomeric material, and the expandable base may comprise a plurality of metal base elements, which can be shifted in a radially outward direction. Additionally, the packer comprises an actuator member connected to a portion of the packer element structure via a release mechanism, e.g., a shear member. The shear member may comprise a tab or a plurality of tabs extending between the expandable base and the actuator member. The shear member effectively provides a shearing mechanism on a radially expanding packer element structure formed of a seal element and a metal substrate to sequentially set the packer. The sequential setting comprises setting the seal element first followed by shearing of the shear member, which then allows setting of the slips. This sequential method creates a jarring effect, which ensures that engagement features, e.g. teeth, of the slips bite into the surrounding borehole surface or harder casing metallurgies.

Figure 1:
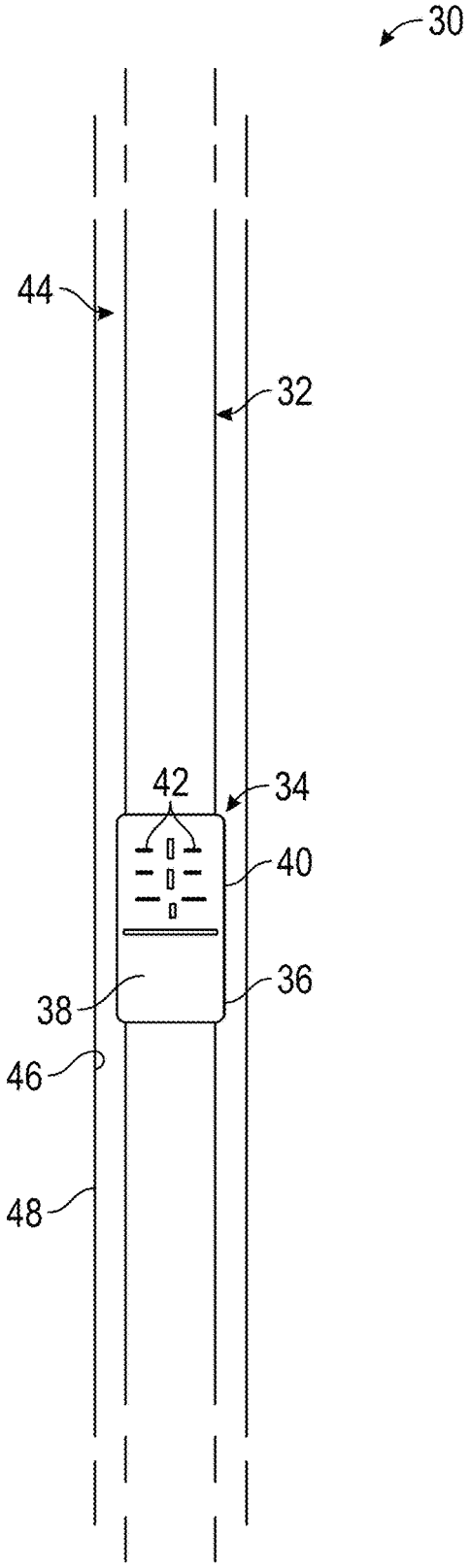
FIG. 1 is a schematic illustration of an example of a packer positioned along a well string located in a borehole, according to an embodiment of the disclosure.

Referring generally to FIG. 1, an example of a well system 30 is illustrated. In this embodiment, the well system 30 comprises a well string 32 including at least one packer 34 having a packer element structure 36 with a sealing element 38. The packer 34 also comprises a slip section 40 which may have a plurality of slips 42. In this example, the well string 32 is positioned in a borehole 44, e.g. a wellbore, having a borehole surface 46 against which the packer 34 maybe set. In some applications, the wellbore 44 maybe lined with a casing 48 and the borehole surface 46 maybe an internal casing surface surrounding the packer 34.

Figure 2:
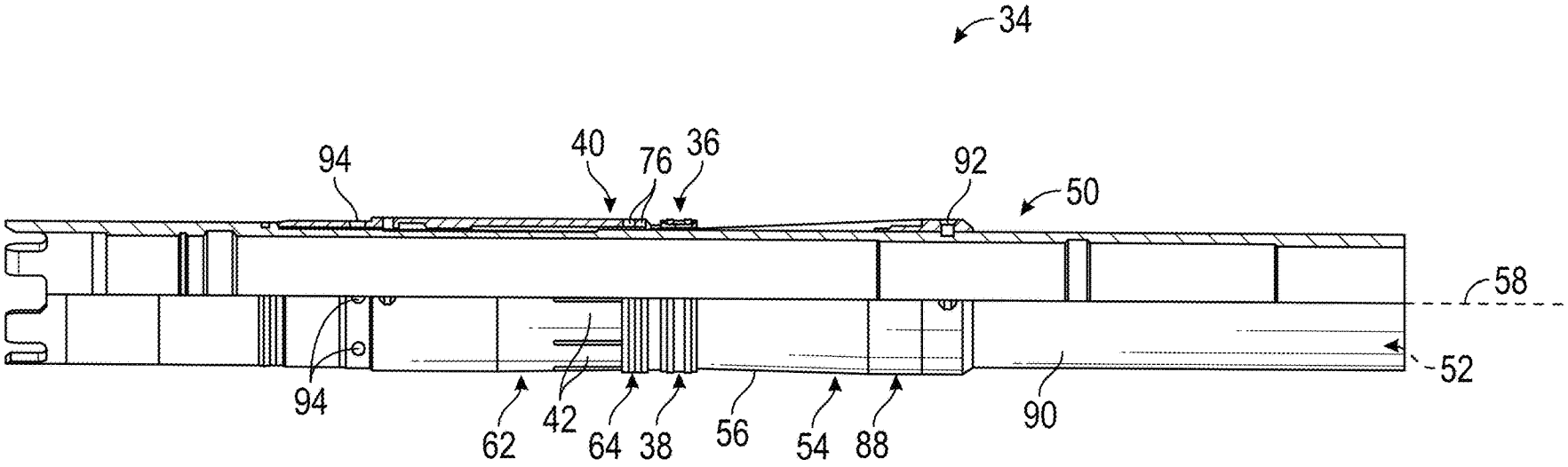
FIG. 2 is a cutaway view of another example of a packer positioned along a well string, according to an embodiment of the disclosure.

Referring generally to FIG. 2, a packer 34 according to one or more embodiments of the present disclosure is shown. As shown, the packer 34 has a center structure 50 having an outer surface 54 that includes a conical/sloped section 56 sloping in a radially outward direction with respect to a longitudinal axis 58 of the packer 34. In this example, the conical/sloped surface 56 of the center structure 50 is created by a cone 88 mounted along a mandrel 90. Cone 88 maybe secured to mandrel 90 via various attachment mechanisms, such as fasteners 92. As also shown in FIG. 2, the packer 34 also includes a packer element structure 36 having a packer sealing element 38, which is expandable and mounted on an expandable base 60 (FIGS. 3-4) positioned along the outer surface 54 of the center structure 50. The packer sealing element 38 maybe formed of a suitable elastomeric material, for example.

Figure 3:
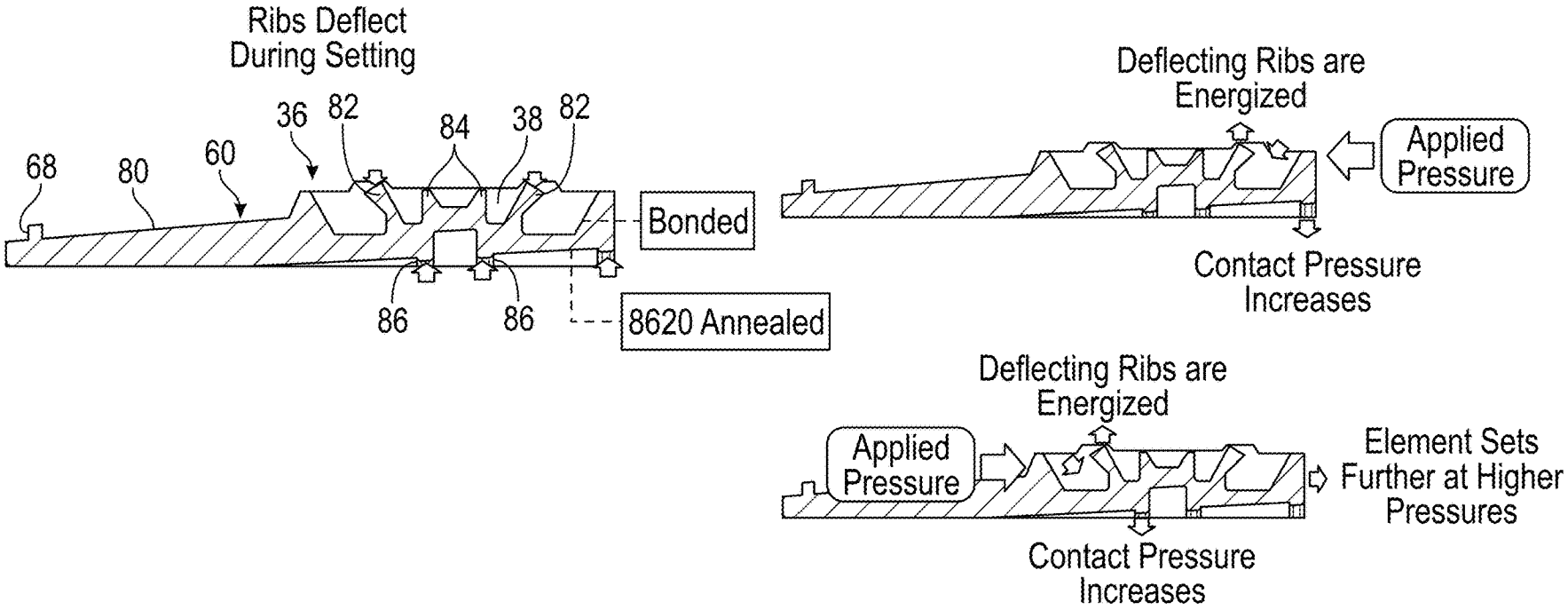
FIG. 3 is a cross-sectional illustration of a portion of the packer illustrated in FIG. 2, according to an embodiment of the disclosure.

Referring now to FIGS. 2 and 3, the packer 34 may also include an actuator member 62 connected to the packer element structure 36. As shown in FIG. 3, the actuator member 62 maybe in the form of a push collet 64 in one or more embodiments of the present disclosure, for example. As further shown in FIG. 3, the actuator member 62 maybe coupled to the expandable base 60 via a release mechanism 66. The release mechanism 66 maybe in the form of a shear member 68, e.g., at least one shear tab. According to the illustrated embodiment of FIG. 3, the shear member 68 may include at least one shear tab extending from the expandable base 60 into a corresponding recess 70 of the actuator member. With further reference to FIG. 2, it should be noted that one method of causing the linear actuation motion of actuator member 62 involves applying annulus pressure to a sealed pressure chamber via ports 94. The pressure is used to drive actuator member 62 linearly along mandrel 90.

Still referring to FIGS. 2 and 3, the packer 34 according to one or more embodiments of the present disclosure also includes a slip structure 40 having a plurality of slips 42. In one or more embodiments of the present disclosure, the slips 42 include engagement members 76, e.g., teeth, constructed to securely engage a surrounding borehole surface 46, e.g., an internal casing surface, when the slips 42 are radially expanded during setting of the packer 34. As shown in FIG. 3, for example, the slips 42 and corresponding teeth 76 are located on the actuator member 62, e.g., on push collet 64, in one or more embodiments of the present disclosure. Additionally, as shown in FIG. 3, a portion of the expandable base 60 is provided with an outwardly sloped surface 80, e.g., a conical surface. In one or more embodiments of the present disclosure, the actuator member 62 may move linearly to set the packer sealing element 38 and to then shear the shear member 68. Once shear member 68 is sheared, continued linear movement of actuator member 62 forces radial expansion of slips 42 as they slide along outwardly sloped surface 80 of expandable base 60.

More specifically, during a packer setting operation, the actuator member 62 is shifted linearly, e.g., in a direction toward packer sealing element 38 along axis 58. The shifting of actuator member 62 maybe achieved via application of pressure along interior passage 52 and/or along the annulus between well string 32 and surrounding borehole surface 46. A variety of pressure piston actuation techniques and other pressure actuation techniques are known in the industry. In some applications, however, the actuator member 62 maybe constructed to be shifted mechanically.

The linear movement of the actuator member 62 causes linear/axial movement of the packer element structure 36 along sloped section 56 of outer surface 54 due to actuator member 62 being coupled to expandable base 60 via shear member 68. Because of the radially outward slope of section 56, the expandable base 60 and the packer sealing element 38 are also forced in a radially outward direction until packer sealing element 38 is moved into sealing engagement with the surrounding borehole surface 46.

As the packer sealing element 38 is forced into engagement with surface 46, further linear movement is resisted. Continued linear movement of actuator member 62 is then able to shear the shear member 68 so as to release the actuator member 62 from packer element structure 36. As a result, the actuator member 62 is able to slide along sloped surface 80 of expandable base 60, which forces slips 42 in a radially outward direction until engagement members/teeth 76 are secured against/into the surrounding wall surface 46. The release due to the shearing of shear member 68 creates a jarring effect during setting of the slips 42, which results in improved engagement of members/teeth 76 with the surrounding wall surface 46. Thus, the packer 34 is able to independently set the packer sealing element 38 followed by subsequent setting of slips 42.

Still referring to FIG. 3, the packer element structure 36 according to one or more embodiments of the present disclosure is in the form of a deflecting rib seal having ribs 82. Ribs 82 extend from a radially inward portion of expandable base 60 such that they are disposed in packer sealing element 38. The ribs 82 deflect during setting and when experiencing borehole pressure from either side, e.g., above or below, of the packer sealing element 38. The expandable base 60 and packer sealing element 38 combine to provide an expandable bonded seal, which energizes when pressure is applied. Such a packer element structure 36 maybe used in a variety of packers 34 including liner top packers. In combination with deflecting ribs 82, the packer element structure 36 may comprise additional ribs 84, e.g. vertical ribs, extending outwardly into packer sealing element 38.

In the illustrated example, the deflecting ribs 82 are on an upper and lower side of the additional ribs 84. For example, the lower deflecting rib 82 maybe oriented in a generally outward and downward direction, and the upper deflecting rib 82 maybe oriented in a generally outward and upward direction. The centrally located ribs 84 may be oriented to project in a radially outward direction and serve to prevent the packer sealing element 38 from undue swaging and also serve as a hard stop which limits the amount of deflection of deflecting ribs 82.

The deflecting ribs 82 deflect when the packer sealing element 38 is set in a sealing position against surrounding borehole surface 46 via application of force. The deflection of the ribs 82 effectively stores setting energy when sealing element 38 is in the sealing position. Advantageously, the deflecting rib seal design according to one or more embodiments of the present disclosure may only require about 50,000 lbf or less of a setting load, which is at least half of what is required in prior art seal assemblies. In some embodiments, the elastomeric material of packer sealing element 38 maybe shaped with a profile so that when pressure is applied the elastomer further pushes the deflected ribs 82 against the surrounding borehole surface 46, e.g.

surrounding casing surface. This ensures the sealing action with the surrounding borehole surface 46 is robust.

The ribs 82, 84 and packer sealing element 38 cooperate to provide a self-energizing seal. For example, the deflecting ribs 82 help energize the packer sealing element 38 with applied pressure which forces the packer sealing element 38 into improved sealing with the surrounding borehole surface 46. Features such as deflecting ribs 82 also help energize the sealing action with applied annular pressure. For example, when pressure is applied from either/both directions (see right side of FIG. 5) the deflecting ribs 82 help energize sealing both on the outside diameter and the inside diameter of packer element structure 36. This energization helps sealing element 38 hold against increased annular pressures acting on packer 34, e.g. pressures upwards of 15,000 psi. In various applications, the deflecting ribs 82 maybe angled upwardly and downwardly to deflect upon setting and to become further energized when pressure is applied from above or below.

In some embodiments, the expandable base 60 also may include internal metal bumps 86 oriented to form an improved metal-to-metal seal with the corresponding outer surface 54 of center structure 50. The internal metal bumps 86 create high contact pressure when the packer sealing element 38 is set against the surrounding borehole wall surface 46. Such a metal-to-metal seal provides a higher resistance to backlash. When pressure is applied from either side of the packer 34, for example, the deflecting ribs 82 and the metal bumps 86 help maintain the seal along the exterior and interior of the packer element structure 36. It should be noted that an inner seal 78, e.g., an O-ring style seal, may be positioned between outer surface 54 and expandable base 60, such as between internal metal bumps 86, for example, to form a suitable seal along the interior of element structure.

According to an embodiment, the packer element structure 36 maybe a swage type seal having expandable base 60 in the form of a metal substrate. The metal substrate may comprise a ductile metal material, e.g. 8620 steel or other suitable ductile steel. In this example, the packer sealing element 38 maybe in the form of a suitable elastomer, e.g. HNBR, bonded to the metal expandable base 60. Depending on the parameters of a given application and/or environment, the materials and configurations selected for the expandable base 60 and packer sealing element 38 maybe adjusted accordingly.

According to an example, slips 42 maybe mounted to or integrally formed with the actuator member 62, e.g. collet 64, and positioned for sliding engagement with a secondary ramp created by sloped surface 80 of expandable base 60 (see FIG. 3). The secondary ramp/sloped surface 80 helps to energize slips 42 for improved slip bite when pressure is applied, e.g., applied on packer sealing element 38. This type of construction effectively provides a high hold down load capacity with a relatively compact slip length by enabling energization of the slips 42 when pressure is applied.

Figure 4:
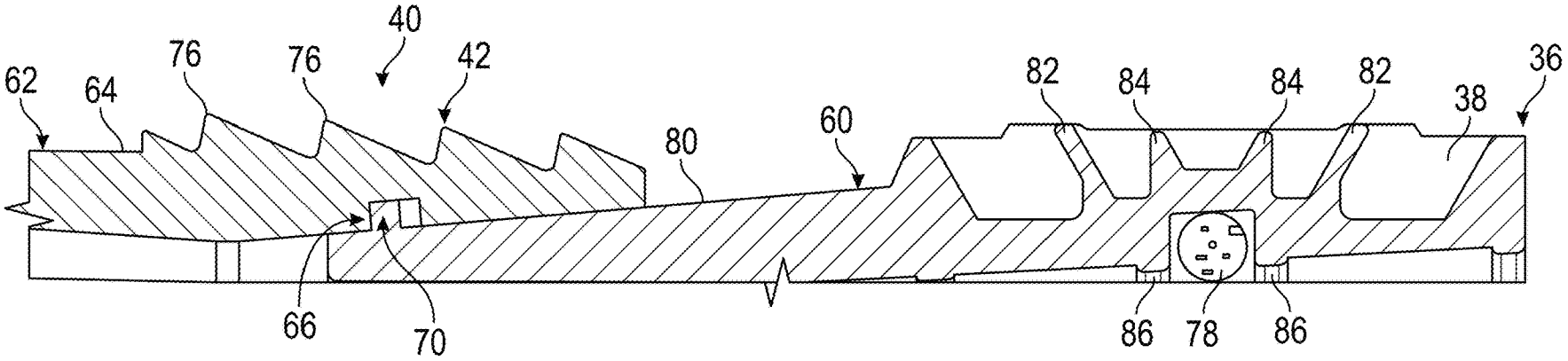
FIG. 4 is a cross-sectional illustration showing features of an example of a packer element structure, according to an embodiment of the disclosure.

As further shown in FIG. 4, it should be noted the packer element structure 36 maybe similar to that described with reference to FIG. 3, having deflecting ribs 82, centrally located ribs 84, packer sealing element 38, and internal metal bumps 86, and this type of construction reduces backlash to improve sealing pressure, as previously described. For example, the configuration prevents backlash on the packer sealing element 38 when lower annulus pressure is applied and energizes the bite of slips 42 as pressure increases (see FIG. 5).

Figure 5:
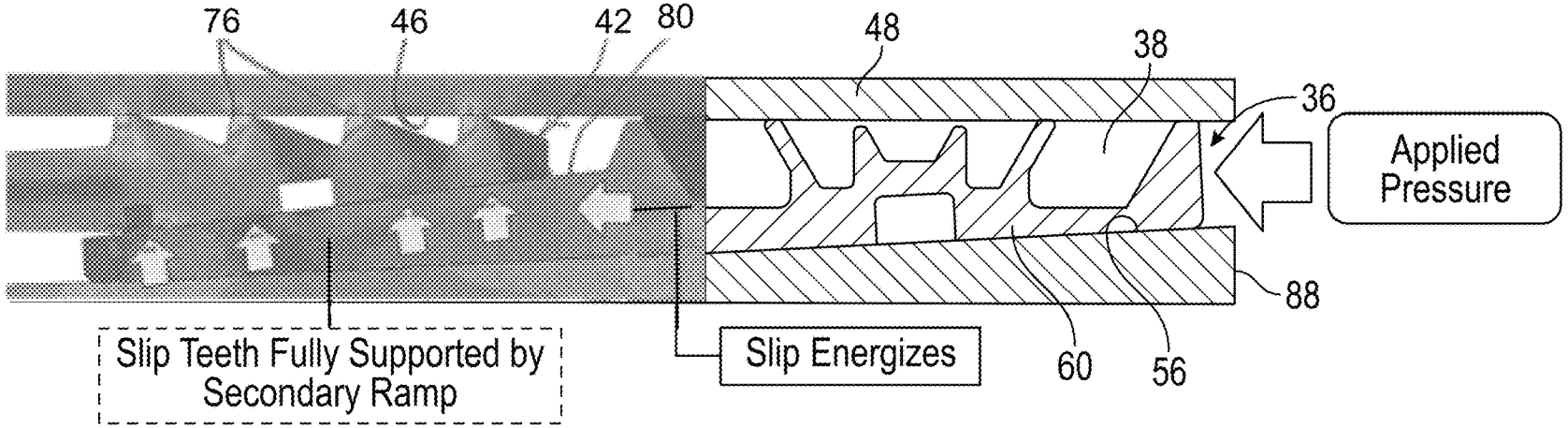
FIG. 5 is an illustration demonstrating actuation of the packer illustrated in FIGS. 2 and 3, according to an embodiment of the disclosure.

Additionally, with reference to FIG. 5, a higher ramp angle or compound ramp angle of secondary ramp/sloped surface 80 maybe used to reduce radial loading experienced by the casing 48 and the mandrel 90, thus providing higher hold down capacity. In this example, the teeth 76 of slips 42 are fully supported by the secondary ramp/sloped surface 80 to help each tooth bite into the surrounding casing 48. Similar to other embodiments, the slips 42 are sequentially actuated using a shear sequence, as described above, so slips 42 become set after the packer sealing element 38 is fully set. The shearing sequence can be used to achieve the desired jarring effect that ensures slips 42 bite into harder metallurgies associated with certain types of casing 48.

It should be noted the packer 34 maybe constructed in various sizes and configurations. For example, the center structure 50, packer element structure 36, actuator member 62, and slips 42 may have a variety of sizes and configurations. In some embodiments, the slips 42 are formed as a unitary part of the actuator member 62 while in other embodiments the slips 42 are formed as a slip ring or other structure separate from actuator member 62. The packer element structure 36 may comprise various types of materials and configurations for forming packer sealing element 38 as well as expandable base 60. Additionally, various integral or separate components may be used in forming sloped surfaces 56 and/or 80.

Figure 6:
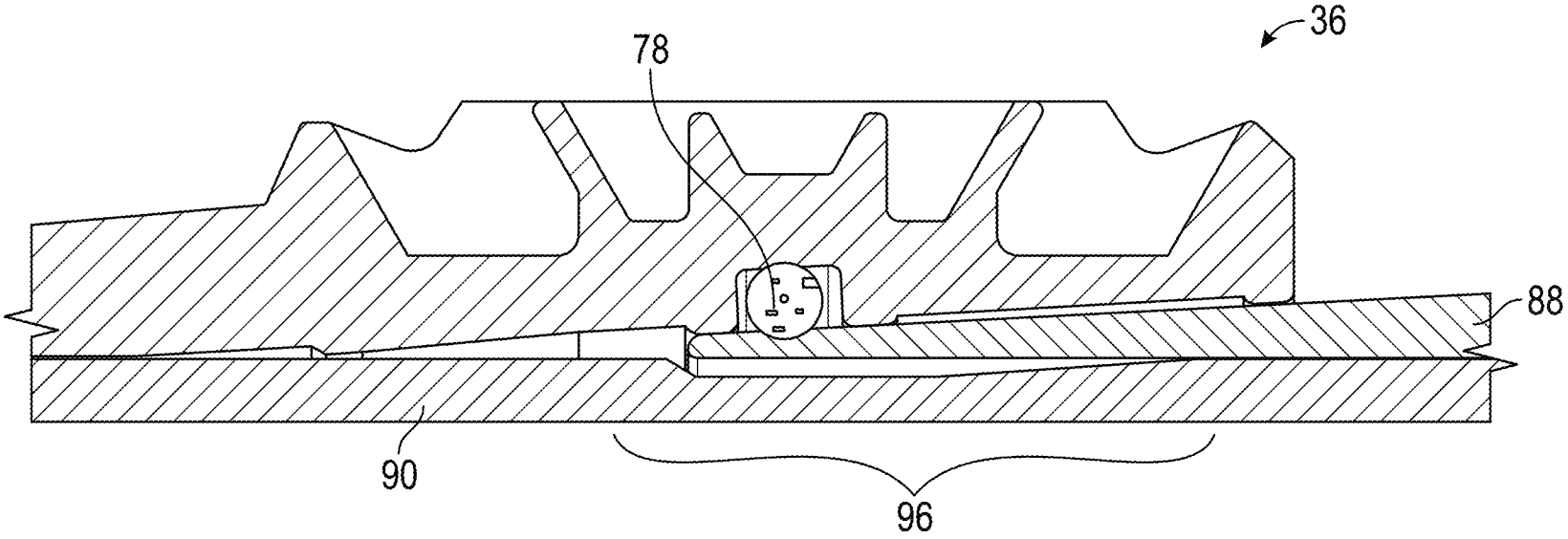
FIG. 6 shows a liner top packer system according to one or more embodiments of the present disclosure.

Referring now to FIG. 6, a liner top packer system including a packer element 36, a cone 88, and a mandrel 90, according to one or more embodiments of the present disclosure is shown. In a typical liner top packer system, the entire packer element is disposed on the cone in the unset position. This typical configuration reduces the cross section of the packer element as the inner diameter (ID) of the packer element is restricted by the outer diameter (OD) of the cone, and the OD of the packer element is restricted by the packer OD. In contrast, in the liner top packer system according to one or more embodiments of the present disclosure, an undercut 96 is added to the mandrel 90 under the cone nose, which allows the packer element ID to be smaller than the cone nose and to be only restricted by the mandrel OD. As further shown in FIG. 6, the packer element 36 is partially off the cone 88 in the unset condition, which increases the cross-section of the packer element 36. Moreover, by adding an undercut 96 to the mandrel 90, the packer element 36 is able to set over the cone 88 without hang-up. This increased cross-section of the packer element 36 allows the packer OD to be reduced, and the bypass area of the packer to be increased. The mandrel undercut 96 may adopt various shapes and configurations without departing from the scope of the present disclosure.

Figure 7:
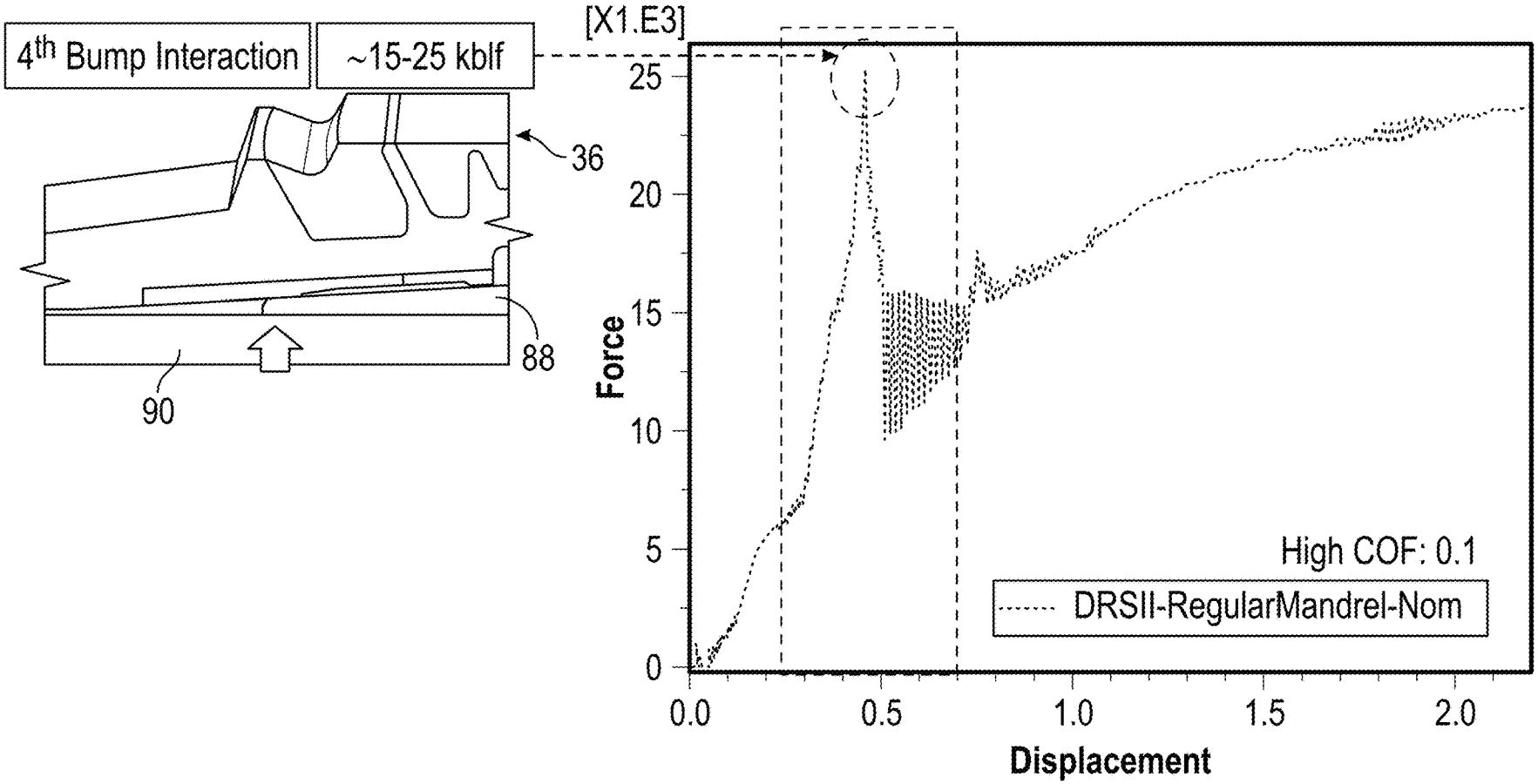
FIGS. 7-8 show comparative results of forces experienced by the liner top packer system during setting of the liner top packer.
Figure 8:
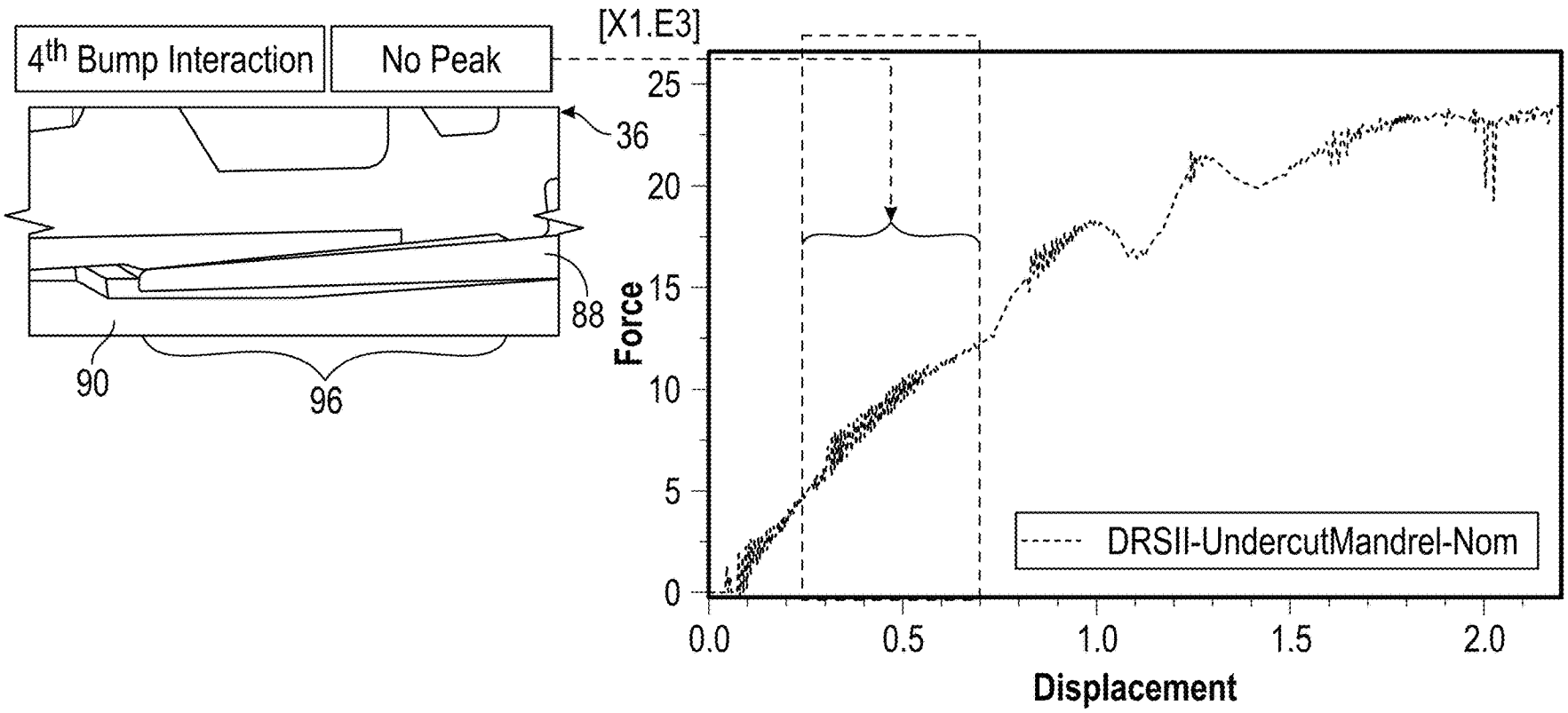

Referring now to FIGS. 7 and 8, comparative results of forces experienced by the liner top packer system during setting of the liner top packer are shown. Specifically, FIG. 7 shows the resulting forces experienced by a liner top packer system without a mandrel undercut, and FIG. 8 shows the resulting forces experienced by a liner top packer system having a mandrel undercut, according to one or more embodiments of the present disclosure.

As shown in FIG. 7, without the mandrel undercut, there are excessively high forces for the packer element to pass over the edge of the nose cone, as evidenced by the peak load (circled), for example. However, as a result of adding the mandrel undercut in accordance with one or more embodiments of the present disclosure, the peak load shown in FIG. 7 is eliminated in FIG. 8. Elimination of excessive load forces during setting of the liner top packer in this way is especially useful when there is a shear event to initiate the setting of the liner top packer, according to one or more embodiments of the present disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string having a packer mounted along the well string, the packer comprising:

a center structure having an outer surface sloping in a radially outward direction with respect to a longitudinal axis of the packer, wherein the center structure comprises a mandrel having an internal passage therethrough, wherein the outer surface of the center structure is a cone positioned about the mandrel;

wherein the mandrel comprises an undercut defining an empty cavity under a nose of the cone and extending beyond a distal end of the nose of the cone;

wherein the nose of the cone is configured to deflect radially into the undercut; and a packer element structure having a sealing element mounted about an expandable base positioned along the outer surface of the center structure.

2. The system as recited in claim 1, wherein the undercut extends a first axial distance under the nose of the cone, the packer element structure axially overlaps with the nose of the cone over a second axial distance from the distal end of the nose of the cone, and the first axial distance is at least half of the second axial distance.

3. The system as recited in claim 1, wherein the packer element structure is partially off the cone in an unset position.

4. The system as recited in claim 1, wherein the undercut comprises one or more tapered surfaces under the nose of the cone.

5. The system of claim 4, wherein at least one tapered surface of the one or more tapered surfaces extends directly under and beyond the distal end of the nose of the cone.

6. The system as recited in claim 1, wherein an actuator member connected to a portion of the expandable base of the packer element structure.

7. The system as recited in claim 6, further comprising a plurality of slips located on the actuator member.

8. The system as recited in claim 6, wherein the actuator member comprises a push collet.

9. The system as recited in claim 1, wherein the sealing element of the packer element structure is elastomeric.

10. The system as recited in claim 1, wherein the expandable base of the packer element structure is formed of ductile metal.

11. The system as recited in claim 1, wherein the packer element structure comprises a plurality of deflecting ribs to facilitate self-energization of the sealing element.

12. A system for use in a well, comprising:

a packer element structure having a sealing element mounted on a metal base, the metal base having vertical ribs and deflecting ribs extending outwardly into the sealing element;

wherein the deflecting ribs having at least one upper deflecting rib and at least one lower deflecting rib such that when the packer element structure is positioned in a generally vertical borehole the at least one upper deflecting rib is angled generally outwardly and upwardly and the at least one lower deflecting rib is angled generally outwardly and downwardly, the deflecting ribs being oriented to deflect during setting of the packer element structure and to be energized when pressure is applied to the packer element structure;

wherein the deflecting ribs extend radially outward to a first outer radius greater than a second outer radius of the vertical ribs to define a radial offset, and the deflecting ribs are configured to deflect radially over the radial offset until reaching a hard stop;

wherein the vertical ribs are located between the at least one upper deflecting rib and the at least one lower deflecting rib; and wherein the vertical ribs define the hard stop to limit an amount of deflection of the at least one upper deflecting rib and the at least one lower deflecting rib.

13. The system as recited in claim 12, wherein the metal base further comprises internal metal bumps positioned on a radially inward side of the metal base and oriented to form a metal-to-metal seal with a corresponding metal surface.

14. The system as recited in claim 13, wherein the internal metal bumps create high contact pressure when the sealing element is set against a surrounding borehole wall surface.

15. The system as recited in claim 12, wherein the packer element structure has a seal positioned in an inner groove.

16. The system as recited in claim 15, wherein the seal is an O-ring seal.

17. The system as recited in claim 12, wherein an actuator member connected to a portion of the metal base of the packer element structure.

18. The system as recited in claim 17, further comprising a plurality of slips located on the actuator member.

19. The system as recited in claim 17, wherein the actuator member comprises a push collet.

20. The system as recited in claim 12, further comprising a center structure disposed within the packer element structure, wherein the center structure comprises a cone disposed about a mandrel, the mandrel comprises an undercut defining an empty cavity under a nose of the cone and extending beyond a distal end of the nose of the cone, and the nose of the cone is configured to deflect radially into the undercut.

* * * * *